United States Patent [19]

Nguyen

[11] Patent Number: 4,535,282

[45] Date of Patent: Aug. 13, 1985

[54] VOLTAGE REGULATION CIRCUIT

[75] Inventor: Chien Nguyen, Davie, Fla.

[73] Assignee: Stromberg-Carlson Corp., Lake Mary, Fla.

[21] Appl. No.: 560,881

[22] Filed: Dec. 14, 1983

[51] Int. Cl.[3] ..... G05F 1/58

[52] U.S. Cl. ..... 323/269; 323/276

[58] Field of Search ..... 323/268, 269, 271, 272, 323/276, 279; 363/65, 71, 72; 340/660, 661, 662, 663

[56] References Cited

U.S. PATENT DOCUMENTS 3,796,919 3/1974 Johnson ..... 323/269 X 4,359,679 11/1982 Regan ..... 323/272

*Primary Examiner*—Peter S. Wong

*Attorney, Agent, or Firm*—Cesari and McKenna

[57] ABSTRACT

A voltage regulation circuit that receives power at an unregulated voltage and supplies power at a regulated voltage to an external circuit. The regulation circuit includes two modules each including a regulator, controlled by a common control, the modules supplying power to the external circuit in tandem. Each module includes a switch and control circuitry that cuts it off from the external circuit if its voltage is outside of a selected range.

14 Claims, 1 Drawing Figure

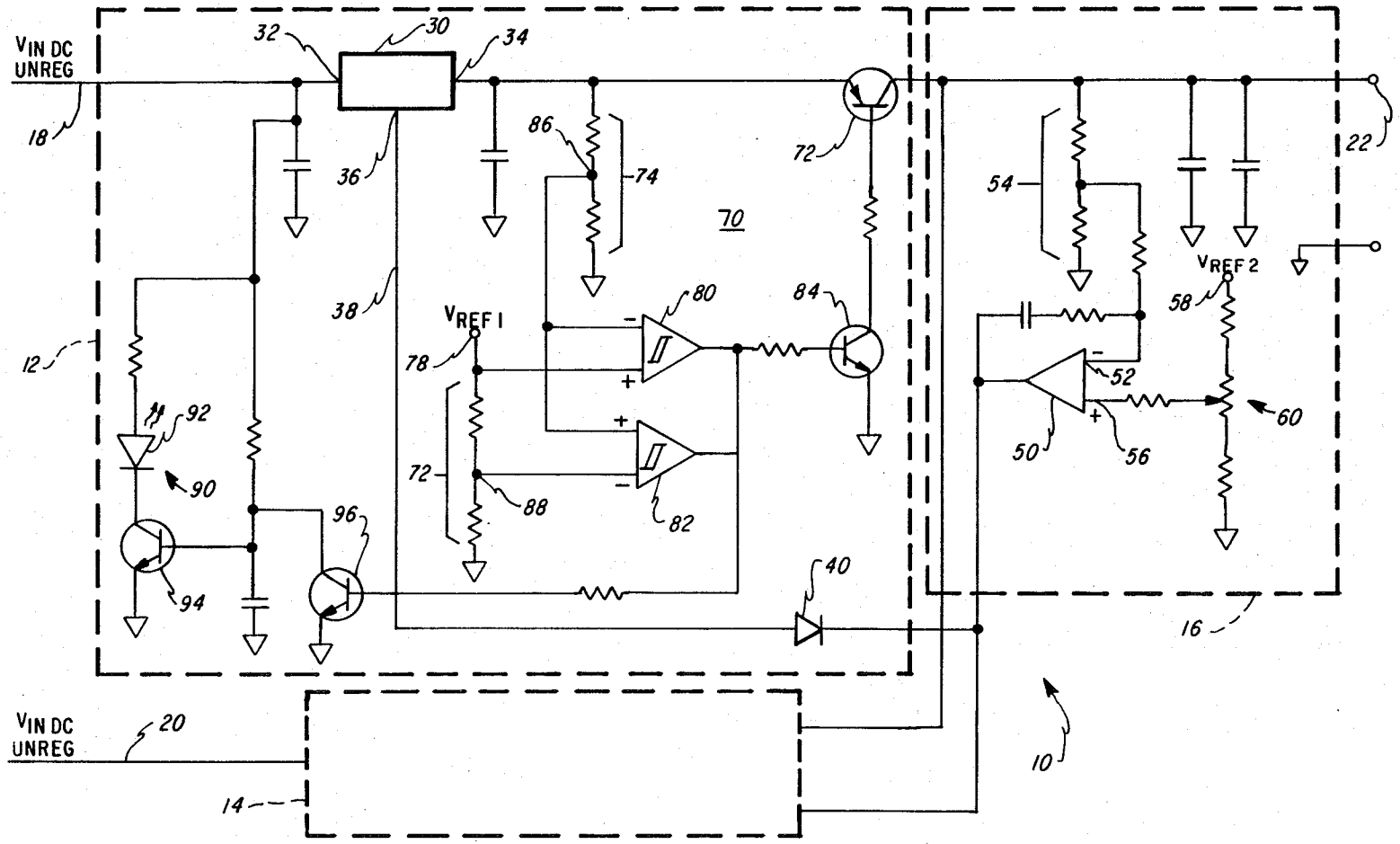
VREF 2
VREF 1
VIN DC UNREG
VIN DC UNREG
10
12
14
16
18
20
22
30
32
34
36
38
40
50
52
54
56
58
60
70
72
74
78
80
82
84
86
88
90
92
94
96

VOLTAGE REGULATION CIRCUIT

BACKGROUND OF THE INVENTION

1. Field of the Invention

The invention relates generally to the field of power supply circuits, and more specifically to voltage regulating circuits in which a plurality of voltage regulator modules supply power to a common load. In the invention, regulation in the modules is achieved by a common control signal, and each of the modules has an under- and over-voltage detector which determines whether the voltage supplied by it is within a predetermined range or outside thereof, and if the voltage is outside, switches the module out of the circuit.

2. Description of the Prior Art

In many applications, it is advantageous to have multiple power supply modules supply regulated voltage to a common load. For example, the redundant supplies permit power to the load to be uninterrupted in the event of the failure of one of the modules. Furthermore, in some cases, current demands may exceed the capability of a single module at the rated voltage. Accordingly, additional power supply modules are provided to supply the excess current to allow the rated voltage to be maintained.

A number of arrangements have been used to remove an individual power supply module in the event of failure. Failure can result in an over-voltage, which can damage a load circuit and can also result in under-voltage, which can draw current from the proplerly functioning module which may be required by the load circuit. In some prior arrangements, when one of the power supplies fail, both of the power supply modules are disconnected from the load, effectively turning off the load. In other arrangements, the individual power supply modules each include a circuit that is cross-connected to sense failure in the other module, and disconnects the other from the load in the event of failure therein. In still other arrangements a common circuit senses the voltage provided by both of the modules, and switches a module out of the circuit if the voltage is outside of a preselected range.

SUMMARY OF THE INVENTION

In brief summary, the invention provides a new power supply circuit in which a plurality of voltage regulating modules connects to separate unregulated voltage sources. The outputs of the modules are connected together to power a common load. Each of the modules includes a voltage regulator that receives the unregulated voltage and generates a regulated output voltage. The voltage regulators all receive a correction signal provided by a common control, which senses the voltage supplied to the load, compares it to a voltage reference, and generates the correction signal in response thereto. The correction signal adjusts the voltage output of the voltage regulators in tandem. Each module includes a switch that disconnects its output from the load if the voltage output of voltage regulator is outside of a preselected range.

BRIEF DESCRIPTION OF THE DRAWING

The invention is pointed out with particularity in the appended claims. The above and further advantages of this invention may be better understood by referring to the following description of an illustrative embodiment taken in conjunction with the accompanying drawing, which depicts a circuit diagram of a voltage regulating circuit according to the invention.

DESCRIPTION OF THE PREFERRED EMBODIMENTS

Voltage regulation circuit 10 includes two voltage regulation modules 12 and 14 and a common control 16. The voltage regulation modules each receive power from one or more unregulated power supplies (not shown) on lines 18 and 20 and supply power at a regulated DC voltage at terminal 22. Lines 18 and 20 may be connected to the same power supply or to separate power supplies; connecting them to separate power supplies will enhance the reliability in the case of failure of any one of the supplies, as power can be provided to the load (not shown) by the other supply and its associated regulation module.

The voltage regulation modules 12 and 14 contain identical circuitry, and therefore details of only one (that is, module 12) are depicted in the drawing. Voltage regulation module 12 includes a three-terminal adjustable regulator 30 which receives power at an unregulated voltage from line 18 at a voltage input 32, and transmits power at a regulated voltage on a voltage output terminal 34. A voltage adjustment terminal 36 receives a correction signal from common control 16 on line 38 through diode 40 which causes regulator 30 to adjust the output voltage at terminal 34.

The common control 16 connects to diode 40 in module 12, and a corresponding diode in module 14 and supplies the correction signal which adjusts, in tandem, the voltage level of the outputs of both regulator 30 and a corresponding regulator in module 14. The common control 16 includes a voltage comparator 50 which has an inverting input 51 connected to terminal 22 through a voltage divider 53. A non-inverting input 56 is connected to a terminal 58, which receives a reference voltage through a variable resistor 60. The voltage of the reference supplied at terminal 58, the setting of variable resistor 60, and the relative resistances of the resistors comprising voltage divider 54, all govern the value of the correction signal applied to diode 40, and the corresponding diode in module 14, and thereby govern the voltage at terminal 22.

Each module 12 and 14 also includes switching circuitry 70 that cuts off or disconnects the voltage output terminal 34 of regulator 30 from terminal 22 in the event the voltage output at terminal 34 is outside of a selected range. A transistor switch 72 couples power from terminal 34 to terminal 22 if the voltage at terminal 34 is within a range selected by a pair of voltage dividers 74 and 76 and a reference voltage at terminals 78.

A pair of comparators 80 and 82 transmits a signal that energizes a transistor 84 when the voltage at output 34 is within the selected range. When transistor 84 is energized, it enables transistor 72 to conduct from terminal 34 to terminal 22.

If, however, the voltage at terminal 34 is above a selected maximum, that is, if the reference voltage at terminal 78 exceeds the voltage at the junction 86 between the resistors comprising voltage divider 74, the output of comparator 80 inverts. When the output of comparator 80 inverts, the input to the base of transistor 84 goes low, turning off transistor 84 which in turn stops transistor 72 from conducting. The module is effectively cut off from terminal 22.

Contrariwise, the voltage at the junction 88 between the resistors comprising voltage divider 72 establishes a minimum voltage in the voltage range. If the voltage at the junction between the resistors comprising voltage divider 74 falls below the selected minimum, the output of comparator 82 inverts, and the input to base 84 similarly goes low. The transistor 72 is therefore switched off, stopping the flow of current from terminal 34 to terminal 22.

Each of the modules 12 and 14 also includes an alarm circuit 90 that indicates when the module's switching circuitry 70 is preventing the flow of current from its terminal 34 to terminal 22. An alarm diode 92, preferably a light emitting diode (LED) is energized by transistors 94 and 96. Transistor 96 in turn is energized by the output of comparators 80 and 82 and, like transistor 84, conducts only when both comparators are transmitting a signal when the voltage at terminal 34 is within the selected range. Accordingly, if the output of either comparator inverts, indicating that the voltage is outside the selected range, transfer 96 switches off, thereby switching off transistor 94 and deenergizing alarm LED 92.

In summary, there has been disclosed a specific embodiment of a voltage regulation circuit including redundant voltage regulation modules controlled in tandem by a common control. The modules together supply regulated voltage to a common load. Each of the modules includes circuitry for disconnecting itself from the load if its voltage output is outside of a selected range. It will be apparent that the specifically disclosed embodiment can be altered while achieving all or some of the advantages of the invention. Therefore, it is the object of the appended claims to cover all such variations and modifications as come within the true spirit and scope of the invention.

What is claimed as new and desired to be secured by Letters Patent of the United States is:

1. A circuit for supplying power at a regulated voltage level to an external circuit comprising:

(A) a plurality of power circuit means each for supplying power to the external circuit, each of said power circuit means having an input terminal for connection to an unregulated power supply and having an output terminal, with all of the output terminals being connected together for connection to the external circuit, each said power circuit means further having:

(i) voltage regulating means connected to said input terminal for receiving power from said unregulated power supply and for generating at an output a regulated voltage at a level determined by a correction signal; and (ii) switch means connected to the output of said voltage regulating means and to said output terminal for receiving the regulated output from said voltage regulating means and for coupling the voltage to the external circuit and for switching off the voltage provided by said voltage regulating means if the voltage from said voltage regulating means is outside of a selected range; and (B) correction signal generating means connected to the output terminals of all of said power circuit means and to all of said voltage regulating means for generating the correction signal and for coupling it to all of said voltage regulating means in response to variations in the regulated voltage at said output terminals to maintain the voltage supplied to the external circuit at a selected level.

2. A circuit as defined in claim 1 in which each circuit means further comprises alarm means connected to its respective switch means for generating an alarm signal in response to the respective switch means cutting off the voltage.

3. A circuit as defined in claim 2 in which said alarm means comprises a light emitting diode energized by the switch means in response to its switching off the voltage supplied to the external circuit.

4. A circuit as defined in claim 1 in which said switch means comprises:

(A) transistor gate means having an input connected to the output of said voltage regulating means and an output connected to the output terminal, said transistor gate means further including gate signal input means for receiving a gate signal that governs the flow of current from said input to said output; and (B) gate signal generating means connected to the output of said voltage regulating means and the gate signal input means for establishing the selected voltage range and for generating a gate signal when the voltage at the output of the voltage regulating means is outside of the selected range.

5. A circuit as defined in claim 4 wherein said gate signal generating means comprises high and low voltage comparators both of which have inputs connected to the output of said voltage regulating means, said high voltage comparator having a second input connected to a high voltage reference signal and said low voltage comparator having a second input connected to a low voltage reference signal, the high and low voltage comparators both having outputs connected to control the gate means in tandem, said high voltage comparator enabling said gate means to generate the gate signal when the output of said voltage regulating means exceeds the high voltage reference signal, and said low voltage comparator enabling said gate means to generate the gate signal when the output of said voltage regulating means is below that of the low voltage reference signal.

6. A circuit as defined in claim 5 in which said gate means constitutes a transistor controlled by the outputs of both said high and low voltage comparators.

7. A circuit as defined in claim 1 in which said correction signal generating means comprises a voltage comparator for comparing the voltage level at said output terminal to a reference voltage and generating a correction signal representative of the amount by which the voltage of the outputs differs from the voltage reference, said voltage comparator having an input connected to the outputs of all of the switch means and a second input connected to the reference voltage, the output of the voltage comparator being coupled as the correction signal to the inputs of all of the voltage regulating means.

8. A power regulating circuit for receiving power from an unregulated power supply at an input terminal and for supplying a regulated voltage at an output terminal to an external circuit comprising a plurality of voltage regulating modules each having an input connected to said input terminal of coupling a regulated voltage output to said output terminal in response to a correction signal generated by a correction signal generating means connected to said output terminal and to each of said voltage regulating modules, the correction signal generating means generating said correction signal in response to the voltage level at said output terminal being in excess of a desired voltage level, each of the regulating modules further comprising switch means for switching off its output to said output terminal if its regulated voltage output is outside of a selected range.

9. A circuit as defined in claim 8 wherein each said voltage regulating modules further includes alarm means connected to its respective switch means for generating an alarm signal in response to the respective switch means switching off the output of said module.

10. A circuit as defined in claim 9 in which said alarm means comprises a light emitting diode energized by the switch means in response to its switching off the output of said module.

11. A circuit as defined in claim 8 in which said switch means comprises:

(A) transistor gate means having an input connected to the output of said voltage regulating module and an output connected to the output terminal, said transistor gate means further including gate signal input means for receiving a gate signal that governs the flow of current from said input to said output; and (B) gate signal generating means connected to the output of said voltage regulating module and the gate signal input means for establishing the selected voltage range and for generating a gate signal when the voltage at the output of the voltage regulating module is outside of the selected range.

12. A circuit as defined in claim 11 wherein said gate signal generating means comprises high and low voltage comparators both of which have inputs connected to the output of said voltage regulating module, said high voltage comparator having a second input connected to a high voltage reference signal and said low voltage comparator having a second input connected to a low voltage reference signal, the high and low voltage comparators both having outputs connected to control the gate means in tandem, said high voltage comparator enabling said gate means to generate the gate signal when the output of said voltage regulating means exceeds the high voltage reference signal, and said low voltage comparator enabling said gate means to generate the gate signal when the output of said voltage regulating means is below that of the low voltage reference signal.

13. A circuit as defined in claim 12 in which said gate means constitutes a transistor controlled by the outputs of both said high and low voltage comparators.

14. A circuit as defined in claim 8 in which said correction signal generating means comprises a voltage comparator for comparing the voltage level at said output terminal to a reference voltage and generating a correction signal representative of the amount by which the voltage of the outputs differs from the voltage reference, said voltage comparator having an input connected to the outputs of all of the switch means and a second input connected to the reference voltage, the output of the voltage comparator being coupled as the correction signal to the inputs of all of the voltage regulating means.

* * * * *